US008201370B1

(12) United States Patent
Goodwin

(10) Patent No.: US 8,201,370 B1
(45) Date of Patent: Jun. 19, 2012

(54) BUILDING BLOCK ASSEMBLY

(76) Inventor: Aaron G. Goodwin, Coral Springs, FL (US)

( * ) Notice: Subject to any disclaimer, the term of this patent is extended or adjusted under 35 U.S.C. 154(b) by 45 days.

(21) Appl. No.: 12/700,907

(22) Filed: Feb. 5, 2010

(51) Int. Cl.

| | |
|---|---|
| ***E04B 2/02*** | (2006.01) |
| ***E04B 2/30*** | (2006.01) |
| ***E04B 2/32*** | (2006.01) |
| ***E04C 1/00*** | (2006.01) |

(52) U.S. Cl. ..... 52/285.2; 52/592.6; 52/604; 52/605; 52/606; 446/123

(58) Field of Classification Search ..... 52/285.2, 52/223.7, 604–606, 592.6; 405/286; 446/123
See application file for complete search history.

(56) References Cited

U.S. PATENT DOCUMENTS

| | | | | |
|---|---|---|---|---|
| 1,172,385 | A * | 2/1916 | Muller | 446/123 |
| 2,058,843 | A * | 10/1936 | Tomasulo | 52/438 |
| 2,810,286 | A * | 10/1957 | Barnhart | 52/310 |
| 3,782,061 | A * | 1/1974 | Minutoli et al. | 52/125.5 |
| 3,846,949 | A | 11/1974 | Okawa | |
| 3,864,443 | A | 2/1975 | Hopkins | |
| 4,026,086 | A * | 5/1977 | Langley | 52/592.6 |
| 4,032,155 | A * | 6/1977 | Thomas | 273/156 |
| D366,140 | S | 1/1996 | Finn | |
| 5,725,655 | A | 3/1998 | Catterton et al. | |
| 5,825,558 | A * | 10/1998 | Farmiga et al. | 359/819 |
| 5,987,840 | A * | 11/1999 | Leppert | 52/592.6 |
| 6,178,714 | B1 * | 1/2001 | Carney, Jr. | 52/564 |
| 6,231,025 | B1 * | 5/2001 | Takemura | 249/40 |
| 6,324,793 | B1 * | 12/2001 | Klanke | 52/124.2 |
| 7,096,636 | B1 * | 8/2006 | Neill et al. | 52/605 |
| 2003/0188501 | A1 * | 10/2003 | Busch et al. | 52/474 |
| 2007/0017176 | A1 | 1/2007 | Gray | |
| 2008/0104906 | A1 * | 5/2008 | Pyo | 52/223.7 |
| 2009/0077920 | A1 | 3/2009 | Korman et al. | |
| 2011/0167749 | A1 * | 7/2011 | Azizi Ronagh | 52/571 |

FOREIGN PATENT DOCUMENTS

| | | | |
|---|---|---|---|
| EP | 0 940 513 | A2 * | 2/1999 |
| WO | 2007/018903 | A2 * | 2/2007 |
| WO | 2010/083575 | A1 * | 7/2010 |

* cited by examiner

*Primary Examiner* — Robert Canfield

(57) ABSTRACT

A building block assembly includes a block that has a top side, a bottom side, a first lateral side, a second lateral side, a front side and a back side. The block has a plurality of apertures therein extending into the top side and outwardly from the bottom side. Each of the apertures is defined by a perimeter wall. The perimeter walls of each of the apertures is cylindrically shaped and has threading grooves therein. The apertures are aligned with each other along a line orientated perpendicular to the front side and are equally spaced from the first and second lateral sides.

18 Claims, 5 Drawing Sheets

BUILDING BLOCK ASSEMBLY

BACKGROUND OF THE DISCLOSURE

Field of the Disclosure

The disclosure relates to construction block devices and more particularly pertains to a new construction block device for building walls in very stable configuration.

SUMMARY OF THE DISCLOSURE

An embodiment of the disclosure meets the needs presented above by generally comprising a block that has a top side, a bottom side, a first lateral side, a second lateral side, a front side and a back side. The block has a plurality of apertures therein extending into the top side and outwardly from the bottom side. Each of the apertures is defined by a perimeter wall. The perimeter walls of each of the apertures are cylindrically shaped and has threading grooves therein. The apertures are aligned with each other along a line orientated perpendicular to the front side and are equally spaced from the first and second lateral sides.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
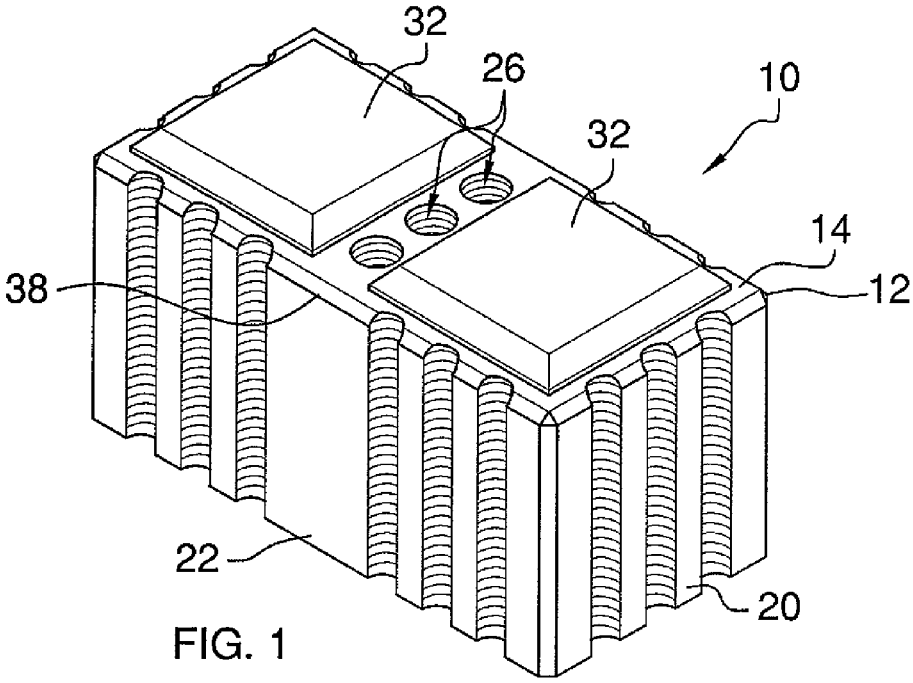
FIG. 1 is a top perspective view of a building block assembly according to an embodiment of the disclosure.
Figure 2:
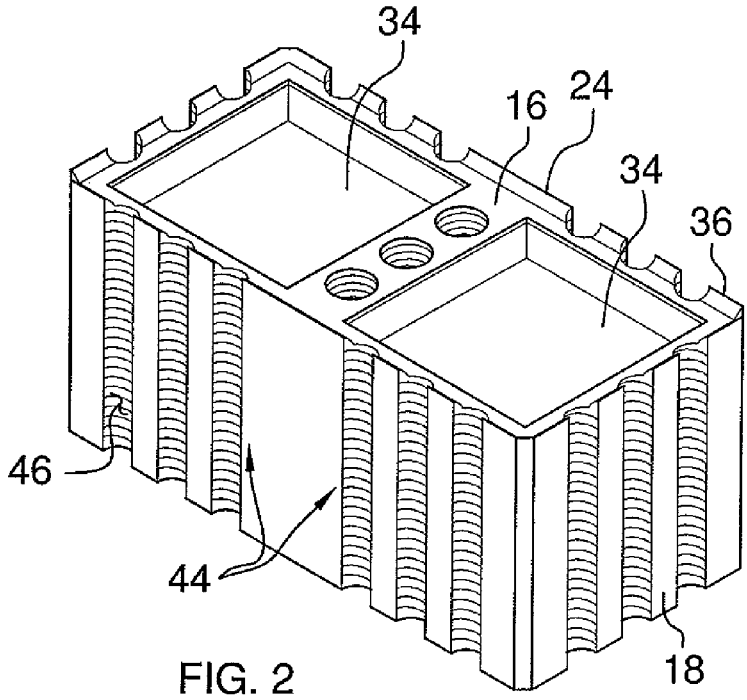
FIG. 2 is a bottom perspective view of an embodiment of the disclosure.
Figure 3:
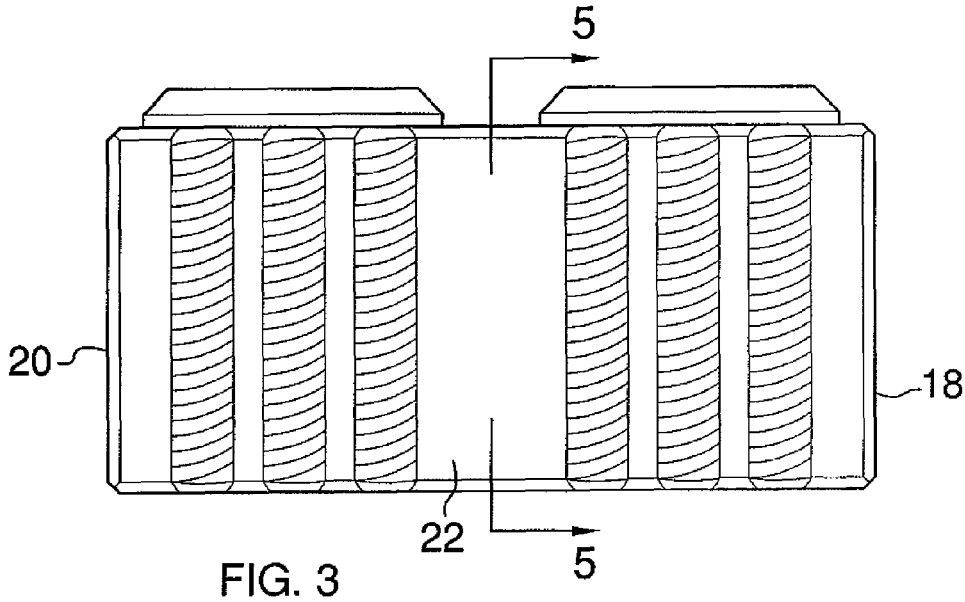
FIG. 3 is a front view of an embodiment of the disclosure.
Figure 4:
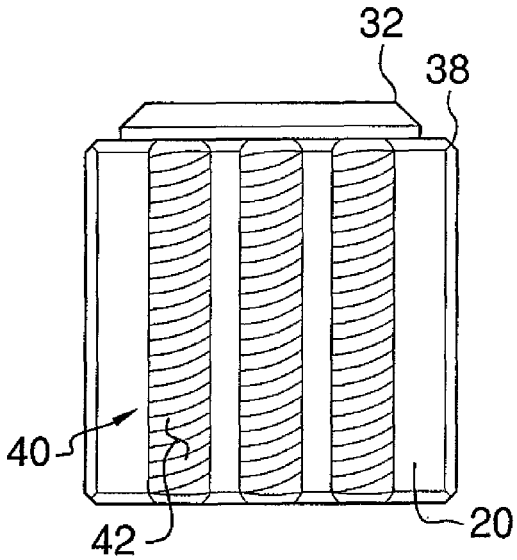
FIG. 4 is a right side view of an embodiment of the disclosure.
Figure 5:
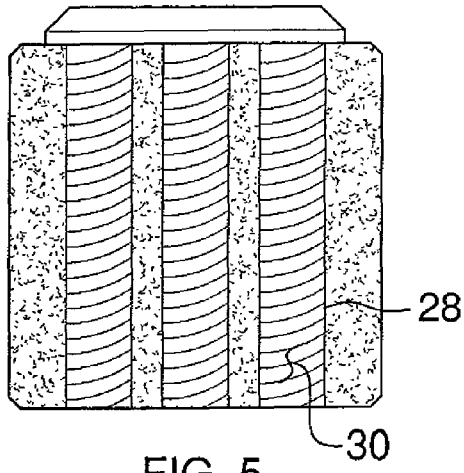
FIG. 5 is a cross-sectional view of an embodiment of the disclosure taken along line 5-5 of FIG. 3.

With reference now to the drawings, and in particular to FIGS. 1 through 8 thereof, a new construction block device embodying the principles and concepts of an embodiment of the disclosure and generally designated by the reference numeral 10 will be described.

As best illustrated in FIGS. 1 through 8, the building block assembly 10 generally comprises a block 12 that has a top side 14, a bottom side 16, a first lateral side 18, a second lateral side 20, a front side 22 and a back side 24. The block 12 has a plurality of apertures 26 therein extending into the top side 14 and outwardly from the bottom side 16. Each of the apertures 26 is defined by a perimeter wall 28. The perimeter walls 28 of each of the apertures 26 are cylindrically shaped and have threading grooves 30 therein. The apertures 26 are aligned with each other along a line orientated perpendicular to the front side 22. The apertures 26 are equally spaced from the first 18 and second 20 lateral sides.

Figure 6:
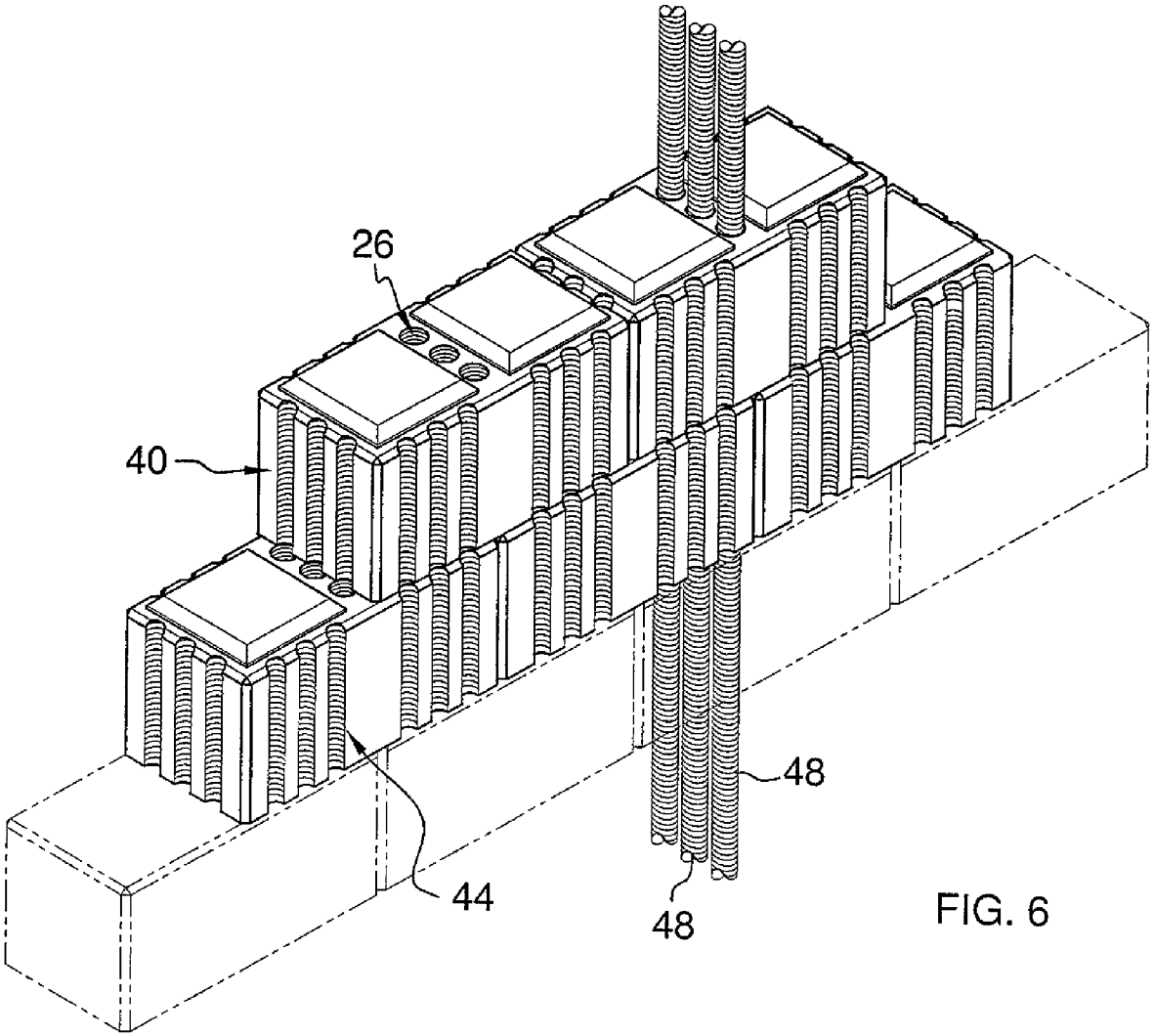
FIG. 6 is a perspective in-use view of an embodiment of the disclosure.
Figure 7:
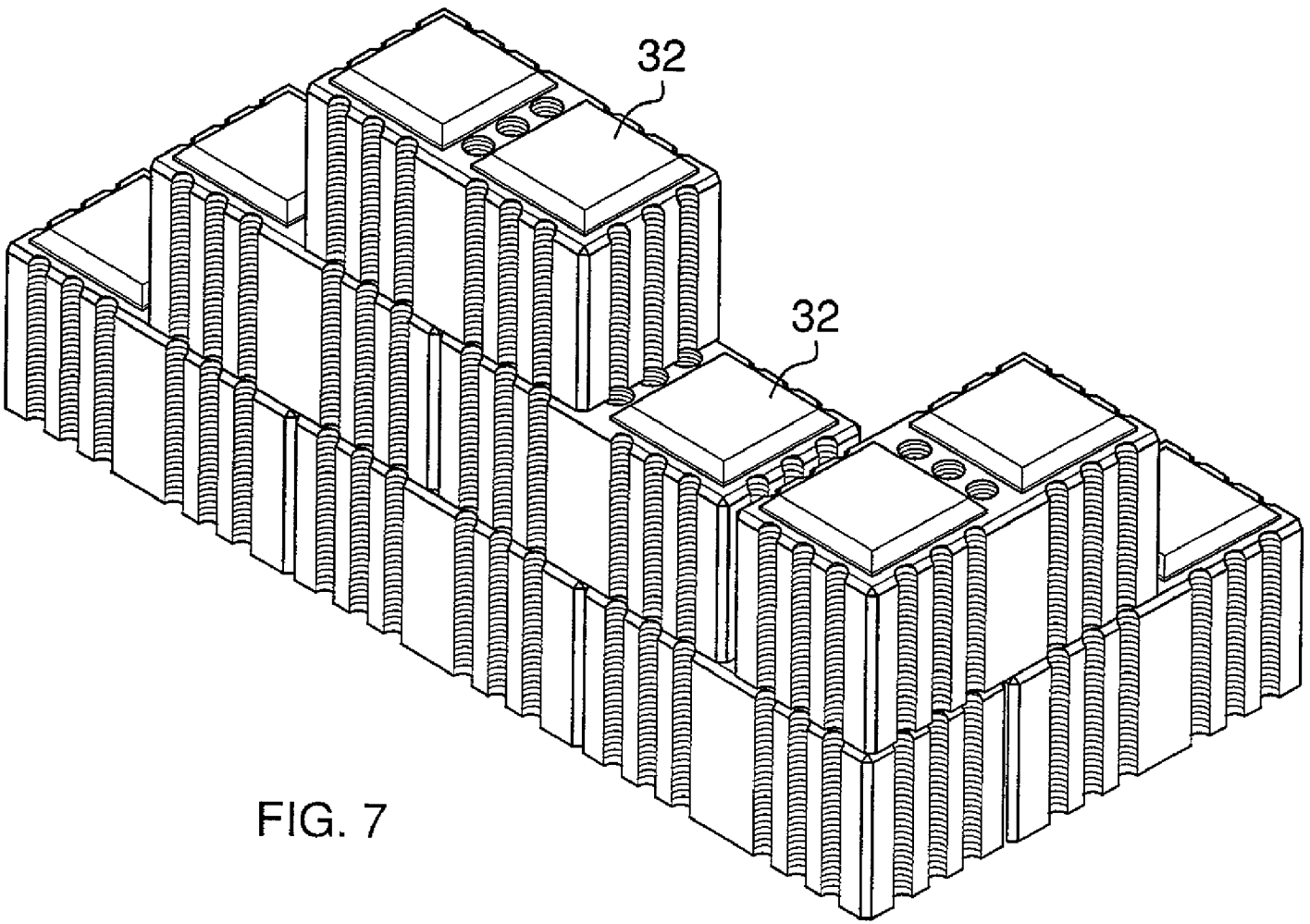
FIG. 7 is a perspective in-use view of an embodiment of the disclosure.
Figure 8:
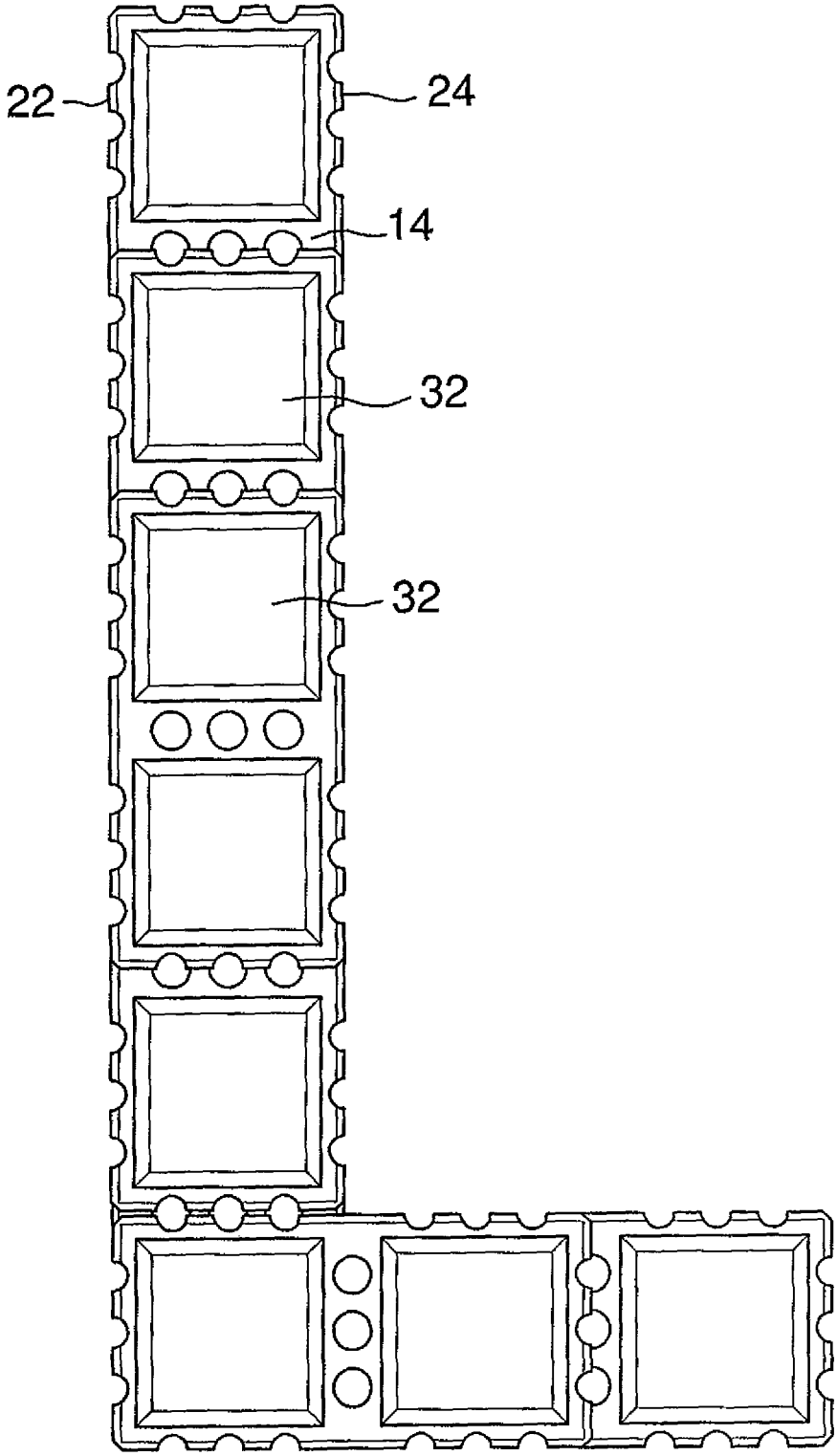
FIG. 8 is a top in-use view of an embodiment of the disclosure.

The top side 14 has a pair of raised sections 32. One of the raised sections 32 is positioned adjacent to the first lateral side 18 and one of the raised sections is positioned adjacent to the second lateral side 20. The bottom side 16 has a pair of indentations 34 therein. Each of the indentations 34 is vertically aligned with one of the raised sections 32. This allows a plurality of blocks 12 to be stacked on top of each other in a more stable configuration. The raised sections 32 are equally spaced from adjacent ones of the first 18 and second 20 lateral edges so that the blocks 12 can be staggered with respect to each other as shown in FIG. 6 while still being assured that the raised sections 32 will be aligned with indentations 34 in the next vertically positioned block 12 regardless of the whether the blocks are or are not staggered. The raised sections 32 and indentations 34 may be frustum shaped. The block 12 may also include an downwardly extending perimeter skirt 36 on the bottom side 16 that engages a perimeter bevel 38 in the top side 14.

The first lateral side 18 and the second lateral side 20 each have a plurality of troughs 40 therein that extend through the top 14 and bottom 16 sides. Each of the troughs 40 in the first lateral side 18 is aligned with one of the troughs 40 in the second lateral side 18. Each of the troughs 40 has a semi-cylindrical shape and each of the troughs 40 has threading grooves 42 therein. The front 22 and back 24 sides each have a plurality of furrows 44 therein that extend through the top 14 and bottom 16 sides. Each of the furrows 44 in the front side 22 is aligned with one of the furrows 44 in the back side 24. Each of the furrows 44 has a semi-cylindrical shape and also has threading grooves 46 therein. The threading grooves 30, 42, 46 primarily in the apertures 26 but also in the troughs 40 and furrows 44, can be used to receive threaded rods 48 which threadably engage the threading grooves 30, 32, 46 to better stabilize the blocks 12 with respect to each other.

The block 12 has a width from the front side 22 to the back side 24 between 7 inches and 8 inches, a length from the first lateral side 18 to the second lateral side 20 between 15 inches and 16 inches and a height from the top side 14 to the bottom side 16 between 7 inches and 8 inches.

The block 12 is comprised of a rigid material. The rigid material may include a mixture of conventional cement and asbestos. Such a combination has many advantages. For instance, since asbestos must be disposed of as a biohazard, its combination solves the problem storing/disposing of the asbestos since it poses little to know danger once combined with the cement. In particular, the mixture would include between 50% and 80% Portland cement and between 20% and 50% asbestos. The block 12, or blocks, may also be used underwater or coated with an elastomer to further prevent any release of the asbestos.

The material mixed with cement may include, with the asbestos or as a replacement therefore, non-radioactive/non-recyclable wastes such as some plastics, vulcanized rubber waste, ground up cinderblocks and the like. However, the heat insulating characteristics of asbestos along with its fibrous structure which binds well with cement, make it an advantageous addition to cement.

In use, the blocks 12 are used in a conventional manner for building walls and the like. While a conventional cinder block shape may be used, it should be understood that the block 12 may have any required shaped needed such as arcuate walls or having notches therein depending on the shape of the wall to be made.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A wall construction assembly comprising:

a block having a top side, a bottom side, a first lateral side, a second lateral side, a front side and a back side, said block having a plurality of apertures therein extending into said top side and outwardly from said bottom side, each of said apertures being defined by a perimeter wall, said perimeter walls of each of said apertures being cylindrically shaped and having threading grooves therein, said apertures being aligned with each other along a line orientated perpendicular to said front side, said apertures being equally spaced from said first and second lateral sides;

said top side having a pair of raised sections, one of said raised sections being positioned adjacent to said first lateral side and one of said raised sections being positioned adjacent to said second lateral side, said bottom side having a pair of indentations therein, each of said indentations being vertically aligned with one of said raised sections; and said first lateral side and said second lateral side each have a plurality of troughs therein and extending through said top and bottom sides, each of said troughs in said first lateral side being aligned with one of said troughs in said second lateral side, each of said troughs having a semi-cylindrical shape, each of said troughs having threading grooves therein.

2. The assembly according to claim 1, wherein said front and back sides each have a plurality of furrows therein and extending through said top and bottom sides, each of said furrows in said front side being aligned with one of said furrows in said back side, each of said furrows having a semi-cylindrical shape, each of said furrows having threading grooves therein.

3. The assembly according to claim 1, wherein said block is comprised of a rigid material.

4. The assembly according to claim 1, wherein said rigid material includes a mixture of cement and asbestos.

5. The assembly according to claim 1, wherein said rigid material includes a mixture of cement and vulcanized rubber waste.

6. The assembly according to claim 1, wherein said rigid material includes a mixture of cement and plastic materials.

7. A wall construction assembly comprising:

a block having a top side, a bottom side, a first lateral side, a second lateral side, a front side and a back side, said block having a plurality of apertures therein extending into said top side and outwardly from said bottom side, each of said apertures being defined by a perimeter wall, said perimeter walls of each of said apertures being cylindrically shaped and having threading grooves therein, said apertures being aligned with each other along a line orientated perpendicular to said front side, said apertures being equally spaced from said first and second lateral sides;

said first lateral side and said second lateral side each having a plurality of troughs therein and extending through said top and bottom sides, each of said troughs in said first lateral side being aligned with one of said troughs in said second lateral side, each of said troughs having a semi-cylindrical shape, each of said troughs having threading grooves therein.

8. The assembly according to claim 7, wherein said block is comprised of a rigid material.

9. The assembly according to claim 7, wherein said rigid material includes a mixture of cement and asbestos.

10. The assembly according to claim 7, wherein said rigid material includes a mixture of cement and vulcanized rubber waste.

11. The assembly according to claim 7, wherein said rigid material includes a mixture of cement and plastic materials.

12. The assembly according to claim 7, wherein said front and back sides each have a plurality of furrows therein and extending through said top and bottom sides, each of said furrows in said front side being aligned with one of said furrows in said back side, each of said furrows having a semi-cylindrical shape, each of said furrows having threading grooves therein.

13. The assembly according to claim 12, wherein said block has a width from said front side to said back side between 7 inches and 8 inches, a length from said first lateral side to said second lateral side between 15 inches and 16 inches and a height from said top side to said bottom side between 7 inches and 8 inches.

14. A wall construction assembly comprising:

a block having a top side, a bottom side, a first lateral side, a second lateral side, a front side and a back side, said block having a plurality of apertures therein extending into said top side and outwardly from said bottom side, each of said apertures being defined by a perimeter wall, said perimeter walls of each of said apertures being cylindrically shaped and having threading grooves therein, said apertures being aligned with each other along a line orientated perpendicular to said front side, said apertures being equally spaced from said first and second lateral sides;

said front and back sides each having a plurality of furrows therein and extending through said top and bottom sides, each of said furrows in said front side being aligned with one of said furrows in said back side, each of said furrows having a semi-cylindrical shape, each of said furrows having threading grooves therein.

15. The assembly according to claim 14, wherein said block is comprised of a rigid material.

16. The assembly according to claim 14, wherein said rigid material includes a mixture of cement and asbestos.

17. The assembly according to claim 14, wherein said rigid material includes a mixture of cement and vulcanized rubber waste.

18. The assembly according to claim 14, wherein said rigid material includes a mixture of cement and plastic materials.

* * * * *